US005605059A

United States Patent [19]

Woodward

[11] Patent Number: 5,605,059

[45] Date of Patent: Feb. 25, 1997

[54] SLEEVED BANGLE BRACELET

[76] Inventor: Robin Woodward, #12 Lucero La., Los Lunas, N.M. 87031

[21] Appl. No.: 400,929

[22] Filed: Mar. 9, 1995

[51] Int. Cl.[6] ..... A44C 5/02

[52] U.S. Cl. ..... 63/5.1; 63/15.7

[58] Field of Search ..... 63/3–6, 15.7

[56] References Cited

U.S. PATENT DOCUMENTS

| | | | |
|---|---|---|---|
| Re. 5,311 | 3/1873 | Sweet | 63/6 |
| 125,516 | 4/1872 | Barclay | 63/6 |
| 255,610 | 3/1882 | Faas | 63/6 |
| 427,592 | 5/1890 | Mathewson | 63/4 |
| 434,302 | 8/1890 | Senner | 63/5.1 |
| 1,201,262 | 10/1916 | Cox . | |
| 1,211,631 | 1/1917 | Schwartzman . | |
| 1,250,153 | 12/1917 | Ellis | 63/5.2 |
| 1,694,703 | 12/1928 | Döppenschmitt . | |
| 2,338,332 | 1/1944 | Jaten . | |
| 2,457,275 | 12/1948 | Ritter . | |
| 2,517,011 | 8/1950 | Meyers . | |
| 2,542,284 | 2/1951 | Matson . | |
| 2,553,563 | 5/1951 | Feid . | |
| 2,608,050 | 8/1952 | Bender | 63/5.2 |
| 2,667,739 | 2/1954 | Flaig . | |

*Primary Examiner*—Flemming Saether
*Attorney, Agent, or Firm*—Dennis F. Armijo

[57] ABSTRACT

The disclosure is directed to a sleeved bangle bracelet and a method of making the bracelet. The bracelet contains a plurality of tubular bangles strung over a contractile band. Several joints are formed when one end of each tubular curved bangle is inserted into a socket on the second end of the adjacent bangle, forming a substantially circular loop. Tension forms the contractile band and holds the joints of the tubular bangles together.

3 Claims, 1 Drawing Sheet

SLEEVED BANGLE BRACELET

BACKGROUND OF THE INVENTION

1. Field of the Invention (Technical Field)

The invention relates to an expansible band for bracelets, watches and the like.

2. Background Art

Several attempts have been made to unite links in an expansible bracelet or band for the arm. These different attempts include U.S. Pat. No. 2,667,739 to Flaig, U.S. Pat. No. 2,553,563 to Feid, U.S. Pat. No. 2,542,284 to Matson, U.S. Pat. No. 2,517,011 to Meyers, U.S. Pat. No. 1,694,703 to Döppenschmitt, U.S. Pat. No. 2,338,332 to Jaten, U.S. Pat. No. 2,457,275 to Ritter, U.S. Pat. No. 1,211,631 to Schwartzman and U.S. Pat. No. 1,201,262 to Cox. These prior art devices suffer from various shortcomings due to their construction. For example, in the devices disclosed in Matson, Döppenschmitt, Jaten and Cox, once the bracelet is placed on an arm they pinch the skin because the links or beads abut against each other. Additionally, these devices are prone to distortion when the links or beads are joined.

The devices described in Flaig, Feid and Meyers contain flanges or stops to prevent the bracelet or band from expanding past a certain point. Therefore, to accommodate a person with large hands or wrists, additional links must be added. These devices are also difficult and expensive to manufacture due to the complexity of the links. Further, it is difficult to add or remove links because they require specialized knowledge or tools. Although the device of Schwartzman does not have flanges, it has several small springs and each of the link springs prohibit expansion past a certain point.

Unlike the present invention, none of the existing devices are constructed to eliminate pinching while easily accommodating all sizes of hands and wrists. Additionally, the present invention is relatively easy and inexpensive to manufacture without complex parts.

SUMMARY OF THE INVENTION (DISCLOSURE OF THE INVENTION)

In accordance with the present invention, there is provided an expansible bracelet apparatus and method of making the bracelet apparatus. The invention prevents pinching of the wearer's skin by the bangles and does not contain complex parts for construction or sizing. The preferred expansible bracelet comprises a contractile band joined at both ends, and a plurality of tubular bangles strung on the contractile band, each tubular bangle comprising a first end comprising a first predetermined diameter, a second end comprising a second predetermined diameter, wherein the second end is slidably insertable within the first end, and an angle of curvature.

The preferred tubular bangles strung on the contractile band comprise partially contracting the contractile band when each of the plurality of tubular bangles are inserted into a next tubular bangle. The preferred angle of curvature comprises an angle wherein the tubular bangles strung on the contractile band form a substantially circular integral loop. The preferred contractile band is removably joined.

Also disclosed is an expansible bracelet comprising a contractile band wherein both ends are removably attached, and a plurality of tubular bangles strung on the contractile band, wherein each of the tubular bangles comprises a socket on a first end for joining a second end of a next tubular bangle.

The preferred tubular bangles comprise a predetermined angle of curvature. The preferred sockets comprise indented sockets. The preferred sockets further comprise a first diameter and the second end comprises a second diameter, the second diameter smaller than the first diameter.

The preferred method of making an expansible bracelet comprises the steps of providing a contractile band, providing a plurality of tubular bangles, disposing a socket on a first end of each tubular bangle wherein the sockets' internal diameter is larger than an external diameter of a second end, curving each tubular bangle at an angle, stringing the plurality of tubular bangles over the contractile band wherein the second end is inserted into the first end and joining the contractile band's ends.

A primary object of the present invention is to provide a simple expansible bracelet that automatically returns to its circular form when worn.

Yet another object is to provide an expansible bracelet that avoids pinching the skin of the wearer.

A primary advantage of the present invention is that is inexpensive and easily manufactured.

Another advantage of the present invention is its simplicity for sizing for different wearers.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

(BEST MODES FOR CARRYING OUT THE INVENTION)

Figure 1:
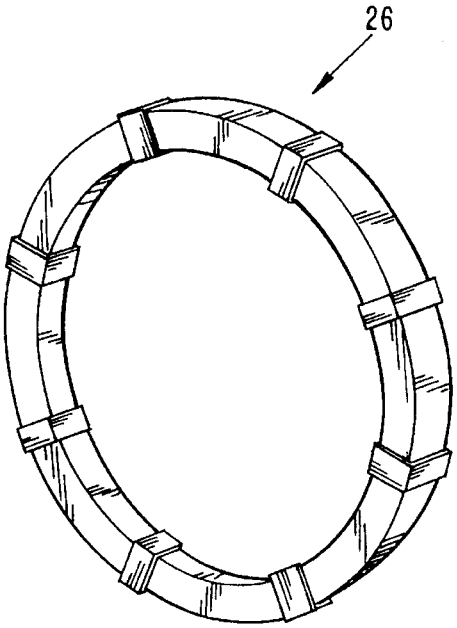
FIG. 1 is a perspective view of the preferred embodiment of the present invention.
Figure 2:
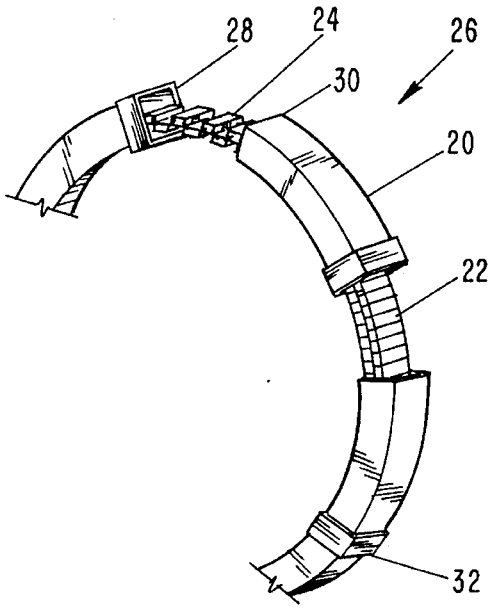
FIG. 2 is a detailed perspective view of the embodiment of FIG. 1 showing the preferred sockets and contractile band.

The sleeved bangle bracelet apparatus and method of making the sleeved bangle bracelet of the present invention provides users with an attractive, safe and comfortable expansible bracelet. One embodiment of the preferred bracelet is in the closed position shown in FIG. 1. A more detailed illustration is shown in FIG. 2. Each tubular bangle 20 is strung over a contractile band 22. Contractile band 22 is preferably a metal watchband composite, but can also be any other type of contractile material or composite, such as springs or elastic (not shown). The length of contractile band can be easily adjusted by removing links 24 to conform to the size of the user's wrist, ankle or other body part. Most metal watchband links can be easily added or removed without special skills or tools. If springs or elastic are used, band 22 can be cut to the correct size. The ends of contractile band 22 are joined to form a continuous loop once tubular bangles 20 are strung. Contractile band 22 is preferably adjusted so that when bracelet 26 is placed around a wrist, or the like, it is not fully constricted. Additionally, contractile band 22 should expand to allow insertion of a hand, or the like, for putting on or removing bracelet 26.

Tubular bangles 20 are constructed with a socket 28 on one end. The inner dimension of rectangular socket 28 is larger than the outer dimension of rectangular end 30. Therefore, rectangular end 30 is inserted into socket 28 to form joint 32. Each tubular bangle 20 is curved at an angle so that when all the tubular bangles are joined, a substantially circular loop is formed. The tension of the not fully constricted contractile band 22 holds the tubular bangles in place. Due to the tubular bangle 20 design including sockets 28, the angle of curvature and resting constriction of contractile band 22, the present bracelet invention returns to its substantially circular shape when placed on a wrist or when not being worn.

Figure 3:
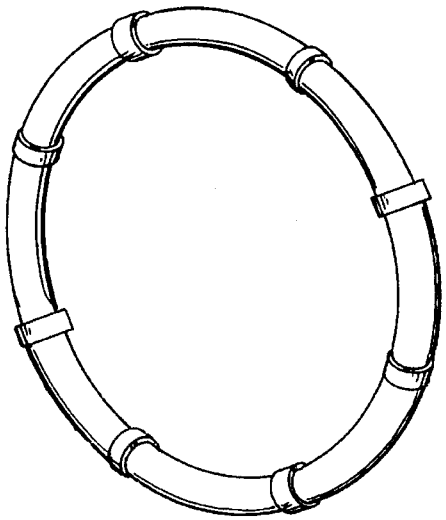
FIG. 3 is a perspective view of an alternative embodiment of the present invention.
Figure 4:
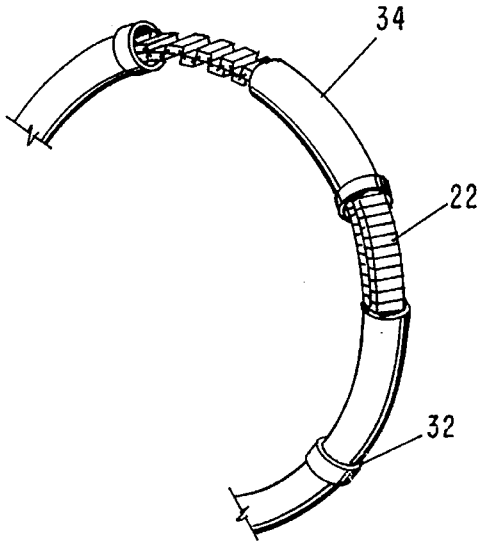
FIG. 4 is a detailed perspective view of the embodiment of FIG. 3 showing the preferred sockets and contractile band.

FIGS. 3 and 4 illustrate an alternative embodiment of the invention. This embodiment contains circular, tubular bangles 34. The functions of contractile band 22 and joints 32 are similar to the preferred embodiment of FIG. 1.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. An expansible bracelet comprising:

a plurality of removable links forming a continuous contractile band joined at both ends wherein the removable links are adapted to adjust the length of the contractile band to conform to a user's body part; and a plurality of tubular bangles strung on said contractile band, each tubular bangle comprising:

a sleeve with a constant first outer dimension and a socket affixed to one end of said sleeve comprising a second outer dimension larger than said first outer dimension;

wherein said sleeve from a next bangle is slidably insertable within said socket; and an angle of curvature.

2. The invention of claim 1 wherein said tubular bangles strung on said contractile band comprise partially contracting said contractile band when each of said plurality of tubular bangles are inserted into a next tubular bangle.

3. The invention of claim 1 wherein said angle of curvature comprises an angle wherein said tubular bangles strung on said contractile band form a substantially circular integral loop.

* * * * *